US005493265A

United States Patent [19]

Whipple et al.

[11] Patent Number: 5,493,265

[45] Date of Patent: Feb. 20, 1996

[54] WIRE SECURING BLOCK

[75] Inventors: Michael J. Whipple, Oakdale; Melvin A. Carrodus, Brighton Township, both of Pa.

[73] Assignee: Eaton Corporation, Cleveland, Ohio

[21] Appl. No.: 339,113

[22] Filed: Nov. 14, 1994

[51] Int. Cl.[6] ..... H01H 9/02

[52] U.S. Cl. ..... 335/202; 174/168

[58] Field of Search ..... 174/168, 169, 174/170, 171, 172, 174; 335/131–132, 202, 6–10; 361/427–429

[56] References Cited

U.S. PATENT DOCUMENTS

| | | | |
|---|---|---|---|
| 3,566,318 | 2/1971 | Gelzheiser et al. . | |
| 4,206,335 | 6/1980 | Kummerow et al. | 200/303 |
| 4,223,289 | 9/1980 | Immel | 335/132 |
| 4,641,225 | 2/1987 | Reichle | 335/202 |
| 4,912,439 | 3/1990 | Nagy et al. | 335/202 |
| 5,291,165 | 3/1994 | Whipple et al. . | |

*Primary Examiner*—Lincoln Donovan
*Attorney, Agent, or Firm*—Martin J. Moran

[57] ABSTRACT

An apparatus for securing a wire with a longitudinal axis includes a glass filled polyester base having a recess for housing a segment of the wire therein; and a glass filled polyester cover for at least partially covering the segment within the recess, the cover having a resilient finger which is generally transverse to the segment, the segment being generally deformed about the resilient finger within the recess in order that tension on the wire along the longitudinal axis flexes the resilient finger which, in turn, forces a portion of the segment against a side of the recess in order to secure the segment therein. The wires may have a polytetrafluoroethylene insulation.

23 Claims, 5 Drawing Sheets

FIG. 1
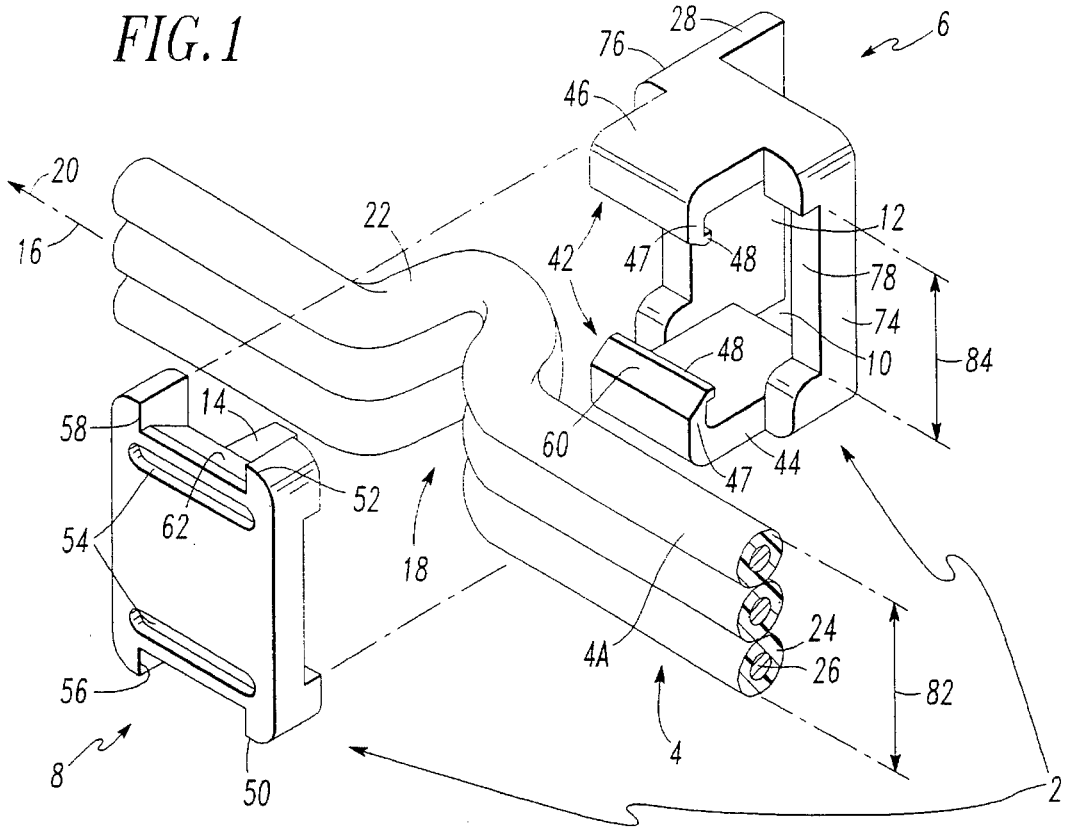
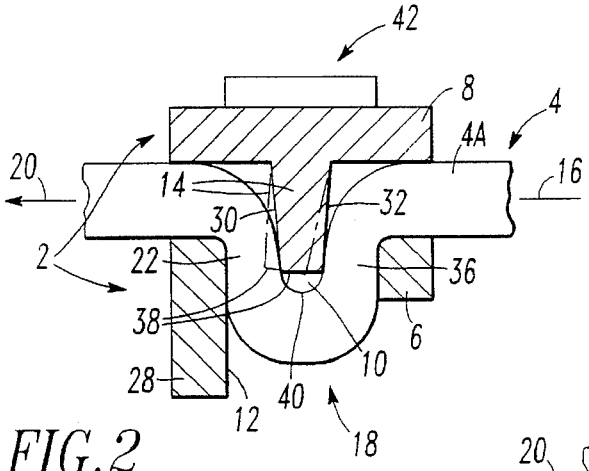
FIG. 2
FIG. 3
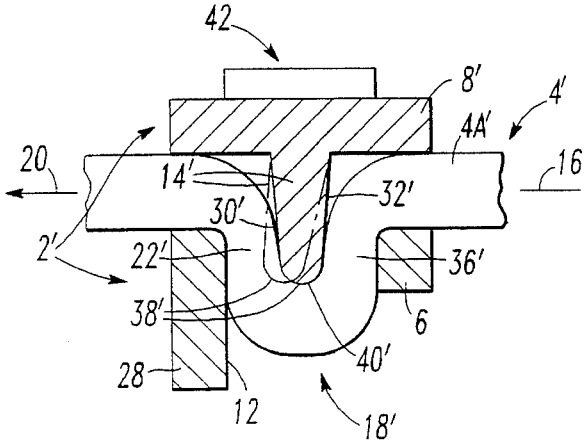

FIG. 4
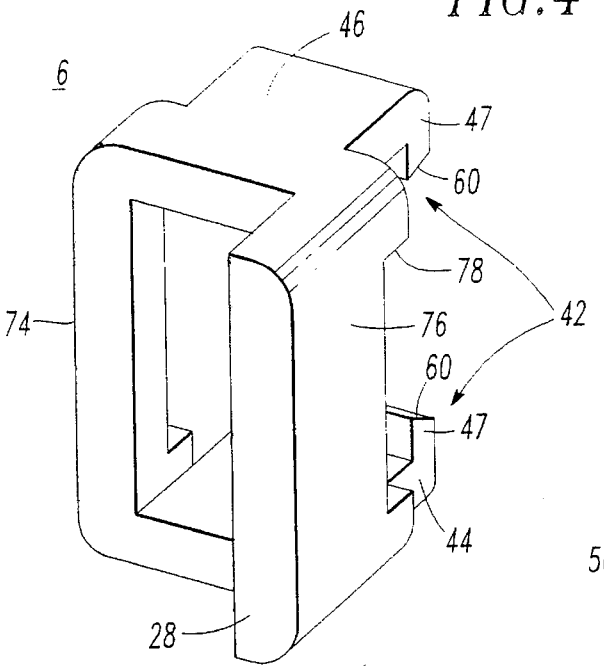
FIG. 5
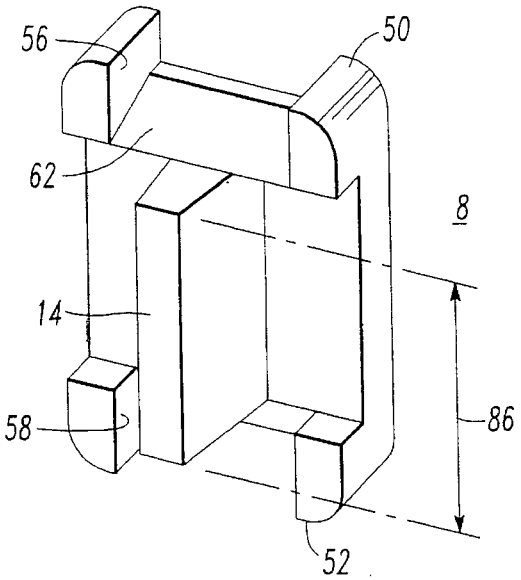
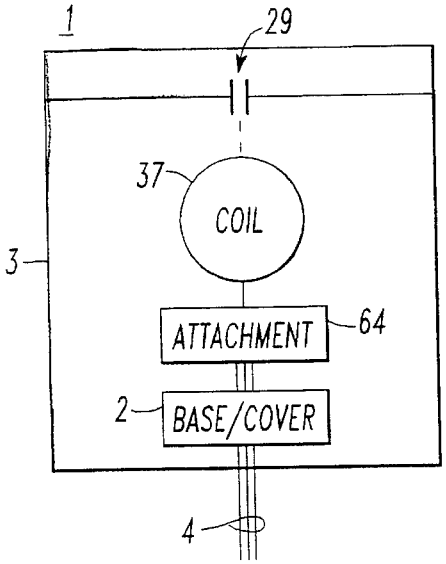
FIG. 6

WIRE SECURING BLOCK

BACKGROUND OF THE INVENTION

1. Field of the Invention

This invention relates to a block for securing a wire and, more particularly, to such a block for securing a wire having polytetrafluoroethylene insulation. The invention also relates to an electrical switching device having auxiliary wiring with polytetrafluoroethylene insulation and a block for securing such wiring.

2. Background of Information

Electrical switching devices include, for example, circuit switching devices and circuit breakers. Circuit breakers are generally used to protect electrical circuitry from damage due to an overcurrent condition, such as an overload fault or a relatively high level short circuit condition. Molded case circuit breakers, for example, include at least one pair of separable contacts which may be operated either manually by way of a handle disposed on the outside of the case or automatically in response to an overcurrent condition. In the automatic mode of operation, an electronic trip unit, for example, controls an operating mechanism which opens the separable contacts. In the manual mode of operation, the handle, for example, cooperates with the operating mechanism in order to open the separable contacts. Electrical switching devices have a line terminal for connection to a power source and a load terminal for connection to a load, such as a motor. The separable contacts of the electrical switching device are internally connected to the line and load terminals.

Electrical switching devices may also have one or more auxiliary connections. In a circuit breaker, for example, such auxiliary connections may be utilized as inputs to provide an external signal for tripping the circuit breaker. Input auxiliary connections may include, for example, connections to a shunt trip mechanism or an undervoltage trip relay which drive an internal solenoid that trips the circuit breaker. Furthermore, other such auxiliary connections may be utilized as outputs to externally indicate the status of the circuit breaker. Output auxiliary connections may include, for example, connections from an internal auxiliary switch to a bell alarm and/or other external circuits for enunciating and/or monitoring the open/closed/tripped status of the circuit breaker. The shunt trip mechanism, the undervoltage trip relay, the internal solenoid, the internal auxiliary switch, the bell alarm, the other external circuits, and other auxiliary devices are generally referred to as attachments.

Some circuit breakers include an external auxiliary terminal block which is utilized for terminating external wires between an external attachment and the terminal block and, also, for terminating internal wires between an internal attachment and the terminal block. Other circuit breakers (e.g., for residential and light industrial and commercial use) do not include an external auxiliary terminal block. In these circuit breakers, auxiliary wires are routed from an internal attachment inside the circuit breaker and are directly connected to an external attachment outside the circuit breaker.

Electrical switching devices generally have limited internal space for the separable contacts, the operating mechanism, the electronic trip unit, and the attachment. In some applications, this results in a relatively high internal operating temperature (e.g., 85° C.). In order to function properly under such internal temperature, electrical switching devices generally utilize auxiliary wires having polytetrafluoroethylene insulation (e.g., "TEFLON", etc.).

As understood by those skilled in the art, polytetrafluoroethylene is sufficiently inert that nothing will bond to it. Furthermore, it is suitably slippery that conventional clamping techniques (e.g., pressure clamps, wire ties, tie-wraps, etc.) cannot adequately hold the polytetrafluoroethylene insulation of the auxiliary wire. Known techniques for clamping such wire involve wrapping the wire around a shaft or providing a large number of bends in order to prevent the wire from being pulled in a straight path. In the limited internal space of an electrical switching device, such techniques subject the wire to stress and, hence, there is room for improvement.

Underwriters Laboratory (UL) provides a variety of tests for the certification of electrical equipment. In a pull-out test, according to UL, each auxiliary wire of an electrical switching device must support a 20 pound weight for one minute. During such test, the auxiliary wire must be disconnected from the internal attachment (e.g., the terminals of an auxiliary switch).

There is a need, therefore, for an improved mechanism for securing a wire having polytetrafluoroethylene insulation.

There is also a need for an improved mechanism for securing an auxiliary wire of an electrical switching device.

There is a more particular need for such a mechanism which secures an auxiliary wire having polytetrafluoroethylene insulation.

There is another more particular need for such a mechanism which secures an auxiliary wire in the limited internal space of the electrical switching device.

SUMMARY OF THE INVENTION

These and other needs are satisfied by the invention which is directed to an apparatus for securing a wire having a longitudinal axis. The apparatus includes a base having a recess for housing a segment of the wire therein; and a cover for at least partially covering the segment within the recess, the cover having a resilient finger which is generally transverse to the segment, the segment being generally deformed about the resilient finger within the recess in order that tension on the wire along the longitudinal axis flexes the resilient finger which, in turn, forces a portion of the segment against a side of the recess in order to secure the segment therein.

The resilient finger may be generally V-shaped with two opposing sides. The portion of the segment may be a first portion. The segment may be generally V-shaped with the first portion and a second portion being angularly disposed with respect to the longitudinal axis. Each of the portions may be adjacent one of the opposing sides. The resilient finger may have a rounded end between the opposing sides. The rounded end may be forced into the wire in order to form the wire which has a rounded portion between the two portions that are angularly disposed with respect to the longitudinal axis. Alternatively, the resilient finger may have a generally flat end between the opposing sides. The segment may have a rounded portion between the two portions that are angularly disposed with respect to the longitudinal axis. The rounded portion may be generally separated from the generally flat end.

The cover may have two ends. The base may have two opposing resilient arms which are cantilevered therefrom. Each of the opposing resilient arms may have an end with a lateral flange which engages one of the ends of the cover. Each of the ends of the cover may have a recess. Each of the lateral flanges may be a confronting flange with a lip which locks one of the recesses of the cover. Each of the ends of the cover may also have a cutout in which one of the opposing resilient arms rests. Each of the cutouts may have a beveled edge and each of the confronting flanges may have a beveled edge which engages one of the beveled edges of the cutouts. The opposing resilient arms may flex away from the cover whenever the cover is pushed onto the base in order that the cover snaps in place with each of the lips locking one of the recesses of the cover.

Alternatively, an electrical switching apparatus includes a housing; separable contacts enclosed within the housing; an operating mechanism for selectively switching the separable contacts; an attachment mechanism cooperating with the operating mechanism, the attachment mechanism having at least one wire with a longitudinal axis, the wire extending outside of the housing; and a holding mechanism for holding the wire, the holding mechanism including a base having a recess for housing a segment of the wire therein; and a cover for at least partially covering the segment within the recess, the cover having a resilient finger being generally transverse to the segment, the segment being generally deformed about the resilient finger within the recess in order that tension on the wire along the longitudinal axis flexes the resilient finger which, in turn, forces a portion of the segment against a side of the recess in order to secure the segment therein. The base may have a flange which rests in a recess of the housing. Preferably, the flange of the base is generally transverse to the longitudinal axis of the wire.

BRIEF DESCRIPTION OF THE DRAWINGS

A full understanding of the invention can be gained from the following description of the preferred embodiment when read in conjunction with the accompanying drawings in which:

FIG. 1 is an exploded isometric view of an apparatus for securing a wire in accordance with the invention;

FIG. 2 is a cross sectional view of an apparatus for securing a wire in accordance with an embodiment of the invention;

FIG. 3 is a cross sectional view of an apparatus for securing a wire in accordance with an alternative embodiment of the invention;

FIG. 4 is an isometric view of a base for an apparatus which secures a wire in accordance with the invention;

FIG. 5 is an isometric view of a cover for an apparatus which secures a wire in accordance with the invention;

FIG. 6 is a block diagram of a circuit breaker in accordance with the invention;

DESCRIPTION OF THE PREFERRED EMBODIMENT

Figure 7:
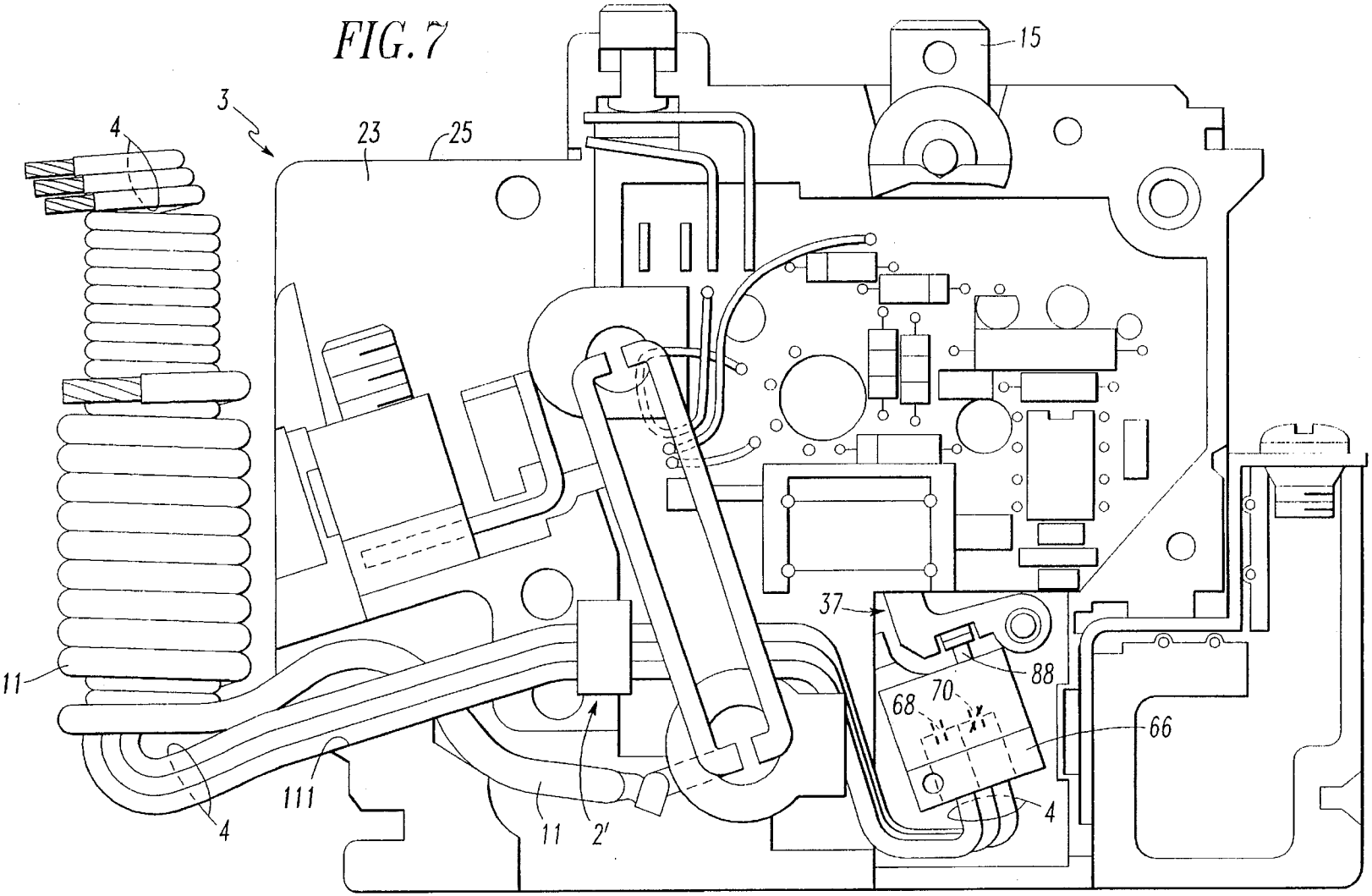
FIG. 7 is an elevation view, with the cover panel removed, of a circuit breaker having an apparatus for securing a wire in accordance with an embodiment of the invention.

Referring to FIG. 1, an apparatus 2 for securing a plurality of wires 4 is illustrated, it being understood that the invention is applicable to a single wire or any number of wires which are positioned side by side. The apparatus 2 includes a base 6 and a cover 8. The exemplary base 6 includes a recess 10 with a side 12 and an open bottom. The exemplary cover 8 includes a resilient finger 14 which is generally transverse to a longitudinal axis 16 of the wires 4 and which engages a segment 18 thereof. As explained in greater detail with FIGS. 2 and 3 below, the segment 18 is generally deformed about the resilient finger 14 within the recess 10 in order that tension along the longitudinal axis 16 (e.g., as indicated by the arrow 20) on one or more of the wires 4 flexes the resilient finger 14 which, in turn, forces a portion 22 of the segment 18 against the side 12 of the recess 10 in order to secure the segment 18 within the recess 10. In this manner, whenever the cover 8 is pushed onto the base 6, the recess 10 houses the segment 18 of the wires 4 therein, and the cover 8 partially covers the segment 18 within the recess 10. Preferably, for high operating temperatures (e.g., 85° C.), the base 6 and the cover 8 are made of glass filled polyester. Alternatively, the base 6 and the cover 8 may be made of any polyester, nylon or molded plastic.

Each of the exemplary wires 4 includes an outer insulator 24 and a stranded inner conductor 26, it being understood that the present invention is applicable to a wide variety of wires including solid and stranded wires with insulators, and solid and stranded wires without insulators. The exemplary insulator 24 is made of polytetrafluoroethylene (e.g., "TEFLON", etc. ), it being understood that the present invention is applicable to a wide variety of insulators such as, for example, rubber or polyvinyl chloride. During an Instron test, which measures tension applied to a wire, whenever the base 6 is secured by a flange 28, as explained in greater detail below with FIG. 8, and up to about 32 pounds of tension is applied to any one of the wires 4, the exemplary apparatus 2 secures the wires 4 without breaking the exemplary insulators 24 and without breaking an associated housing (e.g., the center panel 25 and recess 72 of FIG. 8).

FIG. 2 is a cross sectional view of the apparatus 2 illustrating the segment 18 of the wire 4A within the recess 10 of the base 6. The exemplary resilient finger 14 is generally V-shaped with two opposing tapered sides 30,32. The segment 18 of the wire 4A is also generally V-shaped with the first portion 22 and a second portion 36 being angularly disposed with respect to the longitudinal axis 16 of the wire 4A. The portions 22,36 are adjacent the opposing sides 30,32, respectively. Whenever tension is applied to the wire 4A (e.g., in the direction of the arrow 20) along the longitudinal axis 16, the second portion 36 of the segment 18 is forced against the side 32 of the resilient finger 14 which flexes (as shown in phantom line drawing) and, in turn, the other side 30 of the resilient finger 14 forces the first portion 22 of the segment 18 against the side 12 of the recess 10. In this manner, the tapered finger 14 pinches or squeezes the wire 4A against the side 12 of the recess 10 in order to secure the wire 4A to the apparatus 2, it being understood that the tapered finger 14 engages the other wires 4 of FIG. 1 in a similar manner.

The exemplary end 38 of the resilient finger 14 between the opposing sides 30,32 is generally flat. The exemplary segment 18 of the wire 4A has a rounded portion 40 between the two portions 22,36. The rounded portion 40 is generally separated from the generally flat end 38. Preferably, the rounded portion 40 of the segment 18 is preformed using a resilient plastic (e.g., "DELRIN") rod (not shown) having a rounded end which preforms the exemplary rounded V-shape as defined by the portions 22,40,36 without breaking the insulator 24 of FIG. 1.

Referring to FIG. 3, a cross sectional view of an apparatus 2' including a cover 8' with an alternative resilient finger 14' is illustrated. The resilient finger 14' has a rounded end 38' between the opposing sides 30',32'. In this alternative embodiment of the invention, the rounded end 38' is forced into the wires 4' in order to form the rounded portion 40' of the segment 18'. Otherwise, the apparatus 2' is generally similar to the apparatus 2 of FIG. 2. A first portion 22' opposes a second portion 36' of the segment 18'. The second portion 36' engages the tapered side 32' whenever tension is applied along the longitudinal axis 16 of the wire 4A'. The opposing tapered side 30' forces the first portion 22' against the side 12.

Figure 8:
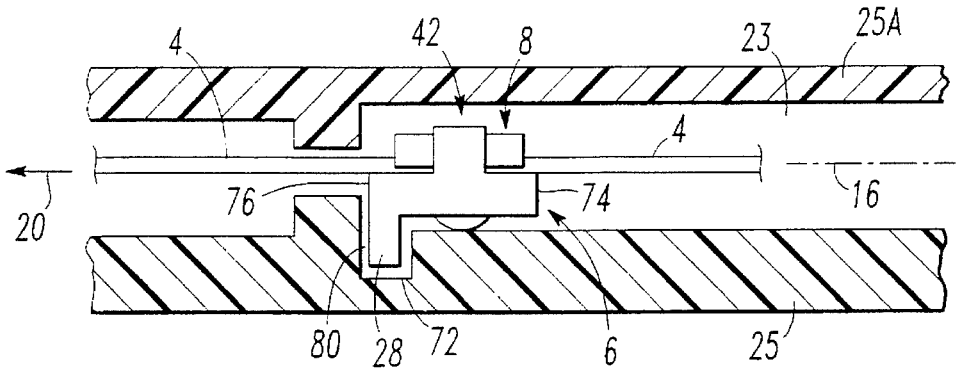
FIG. 8 is cross sectional view of part of a circuit breaker housing and an apparatus for securing a wire in accordance with the invention.

Referring to FIGS. 1–5, the base 6 includes a clamp mechanism 42 for clamping the covers 8,8' to the base 6 (as shown in FIGS. 2, 3 and 8). In this manner, for the embodiment discussed above with FIG. 3, the resilient finger 14' forms the wire 4A' thereabout. The clamp mechanism 42 has two opposing resilient arms 44,46 which are cantilevered from the base 6. Each of the opposing resilient arms 44,46 has an end with a lateral flange 47. The cover 8 has two ends 50,52 and two recesses 54. Each of the lateral flanges 47 engages one of the ends 50,52 of the cover 8. Each of the confronting flanges 47 has a lip 48 which locks one of the recesses 54 of the cover 8. The ends 50,52 of the cover 8 have cutouts 56,58 in which the opposing resilient arms 44,46, respectively, rest.

Each of the cutouts 56,58 has a beveled edge 62. Each of the confronting flanges 47 has a beveled edge 60 which engages one of the beveled edges 62 of the cutouts 56,58. Whenever the cover 8 is pushed onto the base 6, each of the beveled edges 62 of the cover 8 is engaged by a corresponding one of the beveled edges 60 of the flanges 47. During this operation, the opposing resilient arms 44,46 flex away from the ends 50,52, respectively, of the cover 8. Then, whenever the cover 8 snaps in place on the base 6, each of the lips 48 of the confronting flanges 47 locks one of the recesses 54 of the cover 8.

FIG. 6 is a block diagram of a circuit breaker 1 which incorporates the apparatus 2 of FIG. 1 therein, it being understood that the apparatus 2' of FIG. 3 may alternatively be utilized. Examples of the circuit breaker 1 are disclosed in U.S. Pat. Nos. 3,566,318 and 5,291,165 which are both incorporated herein by reference, it being understood that the present invention is applicable to a wide variety of electrical applications such as, for example, electromagnetic switching devices; circuit switching devices; vacuum, air gap and insulating gas contactors or motor starters; and other electrical devices. The exemplary circuit breaker 1 includes a housing 3, a pair of separable contacts 29 enclosed within the housing 3, an operating mechanism 37 (illustrated by a COIL) for selectively switching the separable contacts 29, an attachment mechanism 64, and the exemplary apparatus 2. For convenience, the circuit breaker 1, the housing 3, the pair of separable contacts 29, and the operating mechanism 37 are numbered identically to U.S. Pat. No. 5,291,165. As described in greater detail below with the exemplary embodiments of FIGS. 7 and 10, the attachment mechanism 64 is interconnected with the operating mechanism 37 for cooperation therewith. The attachment mechanism 64 includes the plurality of wires 4. The wires 4 are secured by the apparatus 2 within the housing 3. Each of the wires 4 has a free end which extends outside of the housing 3.

FIG. 7 illustrates an attachment mechanism as embodied by an exemplary auxiliary micro switch 66 which is engaged by the operating mechanism 37. The exemplary micro switch 66 is a conventional switch including a normally open contact 68 (shown in phantom line drawing) and a normally closed contact 70 (shown in phantom line drawing). As explained in greater detail below with FIG. 9, whenever the separable contacts 29 of FIG. 6 are closed, the normally closed contact 70 is closed. On the other hand, whenever the separable contacts 29 are open, the operating mechanism 37 engages the switch 66 in order to open the normally closed contact 70. Two signal leads and a common lead of the switch 66 are connected to the three wires 4 which are secured by the apparatus 2', it being understood that the apparatus 2 of FIG. 1 may alternatively be utilized. In turn, the wires 4 are lead out of the housing 3 through an opening 111 with a pigtail 11, as disclosed in greater detail in U.S. Pat. No. 5,291,165.

FIG. 8 illustrates a compartment 23, a center panel 25 and a cover panel 25A of the housing 3. For convenience, the compartment 23 and the center panel 25 are numbered identically to U.S. Pat. No. 5,291,165. The center panel 25 includes a recess 72 in which the flange 28 of the base 6 rests. As shown in FIGS. 1 and 4, the base 6 has two sides 74,76 each of which has an opening 78 for passing the wires 4 therethrough. The openings 78 are generally along the longitudinal axis 16 of the wires 4. Preferably, the flange 28 of the base 6 is generally coplanar with the side 76. Preferably, the flange 28 is generally transverse to the longitudinal axis 16 of the wires 4. In this manner, whenever tension is applied to the wires 4 on the side 76 of the base 6 (e.g., as shown by the arrow 20), that side 76 bears against a wall 80 within the recess 72.

Referring again to FIGS. 1, 4 and 5, the exemplary wires 4 are positioned side by side and have a width 82 thereacross. The openings 78 of each of the sides 74,76 of the base 6 have a width 84 which is about as large as the width 82 of the wires 4. Similarly, the resilient finger 14 has a width 86 which is about as large as the width 82 of the wires 4.

Figure 9:
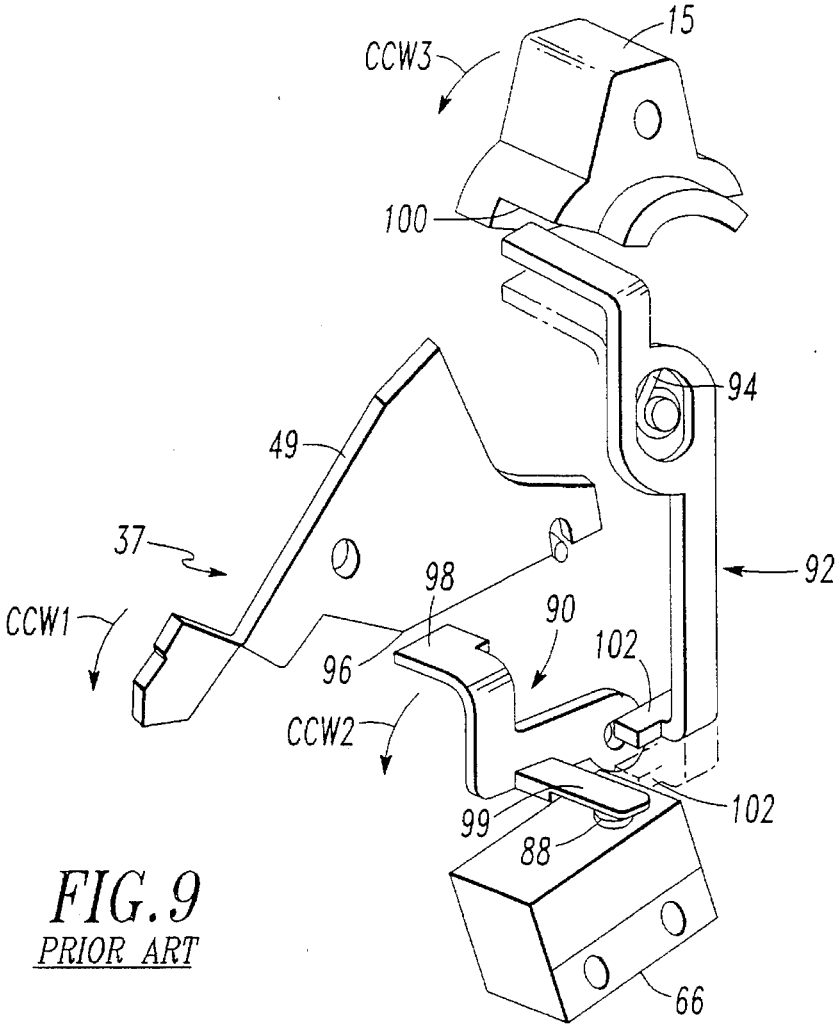
FIG. 9 PRIOR ART
FIG. 9 is a block diagram of an auxiliary switch and an operating mechanism of the circuit breaker of FIG. 7.

FIG. 9 is a block diagram of the exemplary micro switch 66 and the operating mechanism 37. The switch 66 includes a plunger 88 which switches the normally open contact 68 and the normally closed contact 70 of FIG. 7. The operating mechanism 37 further includes two cascaded actuating members 90,92 which actuate the plunger 88 of the micro switch 66. In operation, as discussed in greater detail in U.S. Pat. No. 5,291,165, when the circuit breaker 1 of FIG. 6 is turned on, the separable contacts 29 thereof are closed, the cradle 49 is latched, and the handle 15 is in the on position as shown in FIG. 9. For convenience, the handle 15 and the cradle 49 are numbered identically to U.S. Pat. No. 5,291,165. With the handle 15 in the on position, the second actuating member 92 is biased upward by a torsion spring 94.

Also referring to FIG. 6, when the circuit breaker 1 is tripped, the cradle 49 is unlatched and is rotated counter-clockwise (CCW1) as viewed in FIG. 9, so that a lower edge 96 bears against a first tab 98 of the first actuating member 90 thereby rotating the first actuating member 90 counter-clockwise (CCW2) in order to press a second tab 99 on the plunger 88 of the micro switch 66. Actuation of the switch 66 provides an indication that the separable contacts 29 are open. When the circuit breaker 1 is turned off, the handle 15 is rotated counter-clockwise (CCW3). In turn, a cam surface 100 forces the second actuating member 92 downward against the bias of the torsion spring 94. Then, as shown in phantom line drawing, a tab 102 on the end of the second actuating member 92 bears against the second tab 99 of the first actuating member 90 which depresses the plunger 88 on the micro switch 66. Again, actuation of the switch 66 provides an indication that the separable contacts 29 are open.

Figure 10:
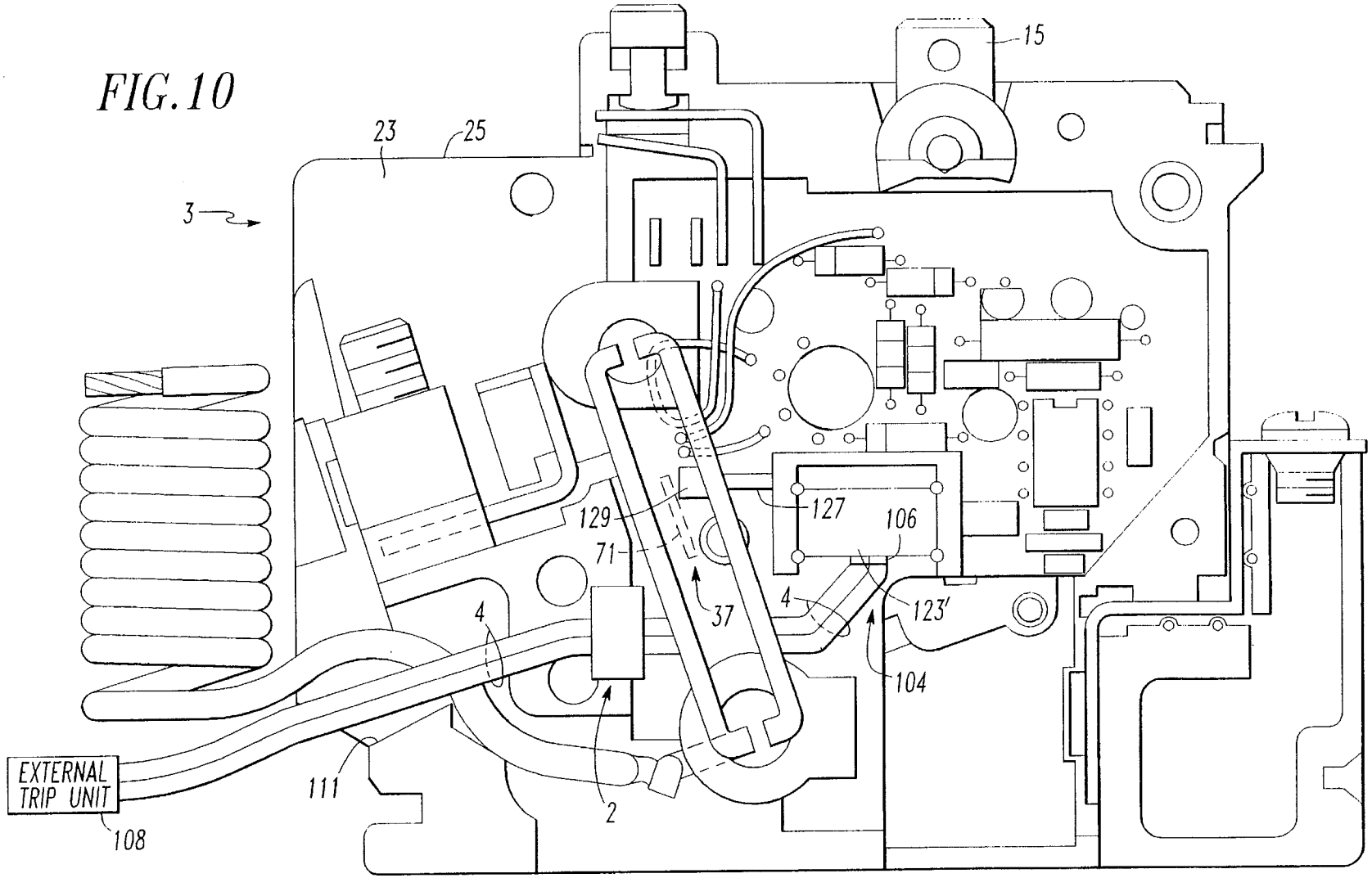
FIG. 10 is an elevation view, with the cover panel removed, of a circuit breaker having an apparatus for securing a wire in accordance with another embodiment of the invention.

FIG. 10 illustrates another attachment mechanism as embodied by an exemplary auxiliary trip mechanism 104 which engages the operating mechanism 37 of U.S. Pat. No. 5,291,165. The auxiliary trip mechanism 104 includes a trip solenoid 123' having a solenoid plunger 127 with a flag 129 secured thereto. The flag 129 pushes an armature 71 (shown in phantom line drawing) in order to trip open the separable contacts 29 of the circuit breaker 1 of FIG. 6. For convenience, the operating mechanism 37, the armature 71, the solenoid plunger 127 and the flag 129 are numbered identically to U.S. Pat. No. 5,291,165. The trip solenoid 123' has a coil input 106 which is connected to the wires 4 and, in turn, to an external trip unit 108. Two signal leads of the input 106 are connected to two of the wires 4 which are secured by the apparatus 2, it being understood that the apparatus 2' of FIG. 3 may alternatively be utilized. In turn, the wires 4 are lead out of the housing 3 through the opening 111 to the external trip unit 108. The trip solenoid 123', in a similar manner as the trip solenoid 123 (not shown) of U.S. Pat. No. 5,291,165, controls switching of the separable contacts 29 by the operating mechanism 37. Whenever the external trip unit 108 energizes the trip solenoid 123', the solenoid plunger 127 is extended in order to trip the circuit breaker 1 of FIG. 6.

Those skilled in the art will appreciate that the circuit breaker 1 of FIG. 6 may utilize other attachments having input wiring for a device such as, for example, an undervoltage trip relay. Similarly, the circuit breaker 1 may utilize other attachments having output wiring for a device such as, for example, a bell alarm. The exemplary apparatus 2 of FIGS. 1–2 and the apparatus 2' of FIG. 3, therefore, provide a mechanism for securing any combination of input and/or output wiring to and/or from any electrical device such as, for example, the exemplary circuit breaker 1.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An apparatus for securing a wire having a longitudinal axis, said apparatus comprising:

base means having a recess with a side, the recess for housing a segment of said wire therein; and cover means for at least partially coveting the segment within the recess, said cover means having resilient finger means being generally transverse to the segment, the segment being generally deformed about the resilient finger means within the recess in order that tension on said wire along the longitudinal axis flexes the resilient finger means which, in turn, forces a portion of the segment against the side of the recess in order to secure the segment therein.

2. The apparatus as recited in claim 1 wherein said wire includes an outer insulator.

3. The apparatus as recited in claim 2 wherein the outer insulator is made of polytetrafluoroethylene.

4. The apparatus as recited in claim 1 wherein the resilient finger means is generally V-shaped with two opposing sides; wherein the portion of the segment is a first portion; and wherein the segment is generally V-shaped with the first portion of the segment and a second portion of the segment being angularly disposed with respect to the longitudinal axis, each of the portions being adjacent one of the opposing sides.

5. The apparatus as recited in claim 4 wherein the tension on said wire along the longitudinal axis forces the second portion of the segment against a first opposing side of the generally V-shaped resilient finger means which flexes and, in turn, a second opposing side of the generally V-shaped resilient finger means forces the first portion of the segment against the side of the recess.

6. The apparatus as recited in claim 4 wherein the resilient finger means has a rounded end between the opposing sides, the rounded end being forced into said wire in order to form said wire which has a rounded portion between the two portions that are angularly disposed with respect to the longitudinal axis.

7. The apparatus as recited in claim 4 wherein the resilient finger means has a generally flat end between the opposing sides; and wherein the segment has a rounded portion between the two portions that are angularly disposed with respect to the longitudinal axis, the rounded portion being generally separated from the generally flat end.

8. The apparatus as recited in claim 1 wherein the resilient finger means is a tapered finger; and wherein said base means includes clamp means for clamping said cover means to said base means in order that the tapered finger forms said wire thereabout.

9. The apparatus as recited in claim 8 wherein the portion of the segment is a first portion; wherein the tapered finger has two tapered sides and a rounded end between the tapered sides, the rounded end forming said wire into a generally V-shaped segment having the first portion and a second portion which engages a first tapered side whenever the tension is applied along the longitudinal axis of said wire, a second tapered side forcing the first portion against the side of the recess.

10. The apparatus as recited in claim 1 wherein said cover means has two ends; and wherein said base means has two opposing resilient arms which are cantilevered therefrom, each of the opposing resilient arms having an end with a lateral flange which engages one of the ends of said cover means.

11. The apparatus as recited in claim 10 wherein each of the ends of said cover means has a recess; and wherein each of the lateral flanges is a confronting flange with a lip which locks one of the recesses of said cover means.

12. The apparatus as recited in claim 11 wherein each of the ends of said cover means also has a cutout in which one of the opposing resilient arms rests.

13. The apparatus as recited in claim 12 wherein each of the cutouts has a beveled edge; and wherein each of the confronting flanges has a beveled edge which engages one of the beveled edges of the cutouts, the opposing resilient arms flexing away from said cover means whenever said cover means is pushed onto said base means in order that said cover means snaps in place with each of the lips locking one of the recesses of said cover means.

14. An electrical switching apparatus comprising:

a housing;

separable contact means enclosed within said housing;

operating means for selectively switching said separable contact means;

attachment means cooperating with said operating means, said attachment means having at least one wire with a longitudinal axis, the wire extending outside of said housing; and holding means for holding the wire, said holding means including:

base means having a recess with a side, the recess for housing a segment of the wire therein; and cover means for at least partially covering the segment within the recess, said cover means having resilient finger means being generally transverse to the segment, the segment being generally deformed about the resilient finger means within the recess in order that tension on the wire along the longitudinal axis flexes the resilient finger means which, in turn, forces a portion of the segment against the side of the recess in order to secure the segment therein.

15. The electrical switching apparatus as recited in claim 14 wherein said attachment means includes auxiliary switch means engaged by said operating means, the auxiliary switch means having a contact which is switched between a closed position and an open position by said operating means, the wire connected to the contact of the auxiliary switch means.

16. The electrical switching apparatus as recited in claim 14 wherein said attachment means includes auxiliary trip means for engaging said operating means, the auxiliary trip means having an input which controls switching of said separable contact means by said operating means, the wire connected to the input of the auxiliary trip means.

17. The apparatus as recited in claim 14 wherein the wire includes an outer insulator which is made of polytetrafluoroethylene.

18. The apparatus as recited in claim 14 wherein said housing includes a recess; and wherein said base means further has a flange which rests in the recess of said housing.

19. The apparatus as recited in claim 18 wherein said base means further has two sides each of which has an opening for passing the wire therethrough; wherein the flange of said base means is generally coplanar with a first side thereof; and wherein the tension is applied to the wire on the first side of said base means.

20. The apparatus as recited in claim 18 wherein said base means further has an opening for passing the wire therethrough, the opening being generally along the longitudinal axis of the wire; and wherein the flange of said base means is generally transverse to the longitudinal axis of the wire.

21. The apparatus as recited in claim 14 wherein said at least one wire is a plurality of wires; and wherein said base means further has two sides each of which has an opening for passing the wires therethrough.

22. The apparatus as recited in claim 21 wherein the wires are positioned side by side and have a width thereacross; and wherein the opening of each of the sides of said base means has a width which is about as large as the width of the wires.

23. The apparatus as recited in claim 22 wherein the resilient finger means has a width which is about as large as the width of the wires.

* * * * *